US005588372A

United States Patent [19]

Kelly

[11] Patent Number: 5,588,372

[45] Date of Patent: Dec. 31, 1996

[54] STACKABLE DISPENSING APPARATUS FOR WIRE REELS

[75] Inventor: Patrick J. Kelly, Hartlebury, England

[73] Assignee: National-Standard Company

[21] Appl. No.: 239,278

[22] Filed: May 9, 1994

[51] Int. Cl.[6] ..... B65D 19/44

[52] U.S. Cl. ..... 108/55.1; 108/53.1

[58] Field of Search ..... 108/55.1, 55.3, 108/51.1, 53.1, 53.3, 53.5, 54.1

[56] References Cited

U.S. PATENT DOCUMENTS

| | | | |
|---|---|---|---|
| 2,998,141 | 8/1961 | Moore et al. | 108/53.5 X |
| 3,107,024 | 10/1963 | Johnson et al. | 108/53.5 X |
| 3,207,095 | 9/1965 | Hiatt, Jr. | 108/53.5 |
| 3,602,368 | 8/1971 | Gould | 108/55.1 X |
| 3,643,988 | 2/1972 | Ingvartsen | 108/53.5 X |
| 3,762,343 | 10/1973 | Thacker | 108/53.3 |
| 4,295,431 | 10/1981 | Stavlo | 108/55.1 |
| 4,732,528 | 3/1988 | Good | 108/55.1 X |

*Primary Examiner*—Jose V. Chen
*Attorney, Agent, or Firm*—Emrich & Dithmar

[57] ABSTRACT

A stackable storing and dispensing apparatus for reels of wire includes a pallet structure having reinforced corners posts with selected corner posts including complimentary engageable members mounted to the upper and lower ends of the corner posts and extending between selected corner posts. The complimentary engageable members mounted to the ends of the corner posts are structurally arranged to provide nesting and stacking of the dispensing apparatus when one pallet structure is positioned on top of another pallet structure. The dispensing apparatus includes a restraining member which locks the vertically orientated reels of wire within the pallet structure and which is movable to an open position which permits removal of the reels of wire from the apparatus.

26 Claims, 2 Drawing Sheets

FIG. 9
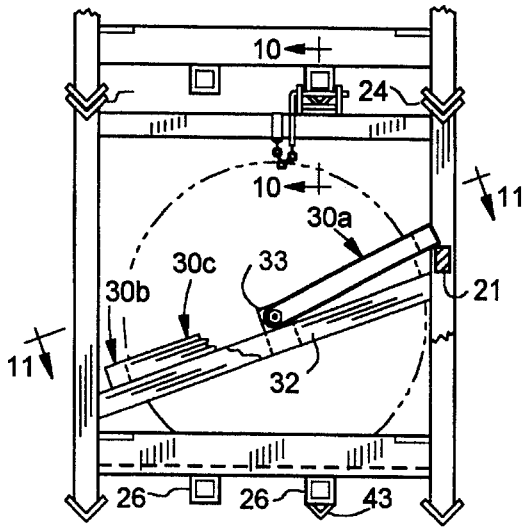
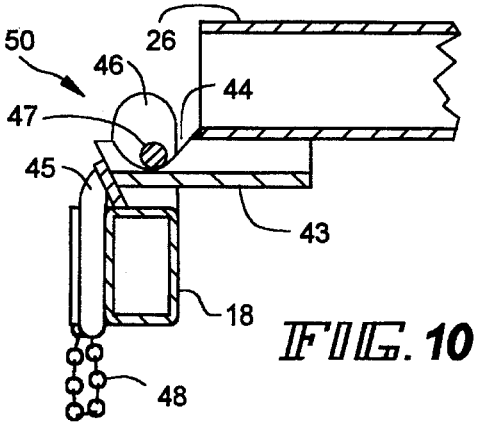
FIG. 10
FIG. 12
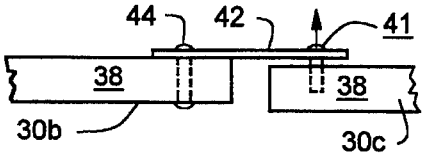
FIG. 11
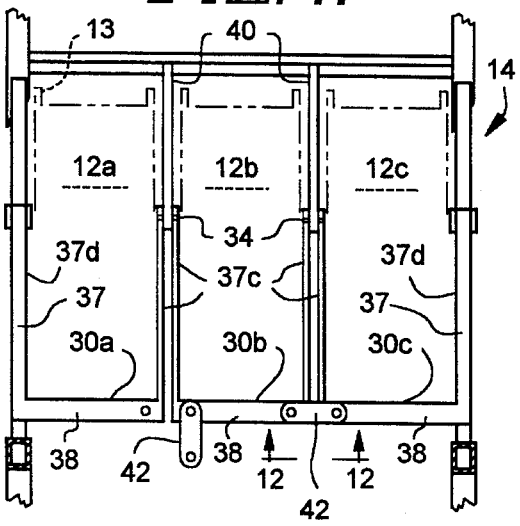
FIG. 6
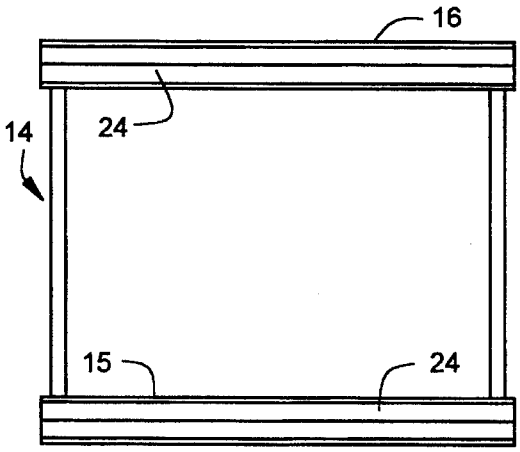
FIG. 8
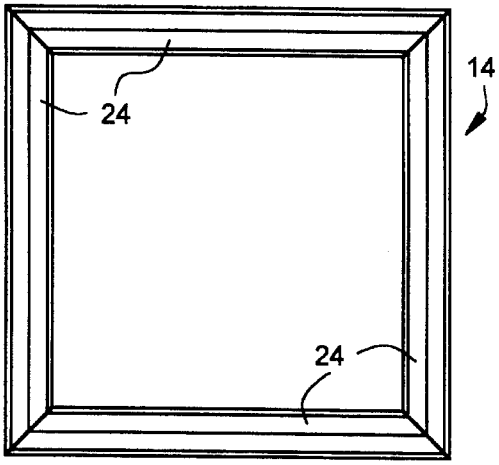
FIG. 7
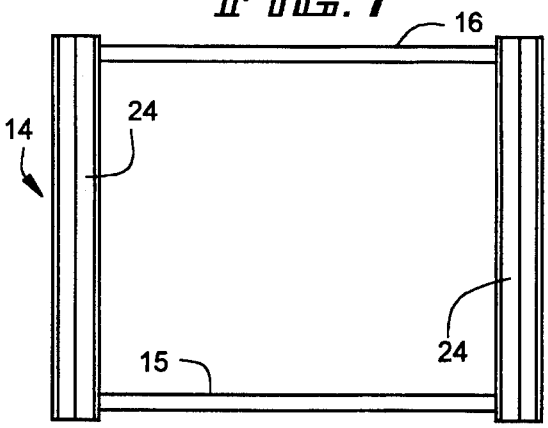

STACKABLE DISPENSING APPARATUS FOR WIRE REELS

BACKGROUND OF THE INVENTION

The present invention relates to an improved stackable pallet dispensing apparatus which is adapted to receive and hold vertically a plurality of reels of wire.

In the past, it has been suggested that a pallet structure include recessed support members positioned on the base of the pallet structure. The recessed support members are adapted to receive a plurality of reels of wire vertically orientated in side by side relationship and to retain the reels of wire on the pallet structure. Additionally, such reels are secured to the pallet with bands, for example. Moveover, some pallet structure designs include corner posts thereon, the upper portion of each of the corner posts having a protuberance and the lower portion of each corner post containing a recessed opening. When it is desired to stack such pallet structures one on top of the other, it is necessary to align the recessed openings on the lower portions of each corner with the protuberances extending upwardly from each corner post. However, because of the substantial weight of the wire reels upon each pallet structure and the extreme difficulty of aligning each protuberance with the corresponding recessed opening, such stackable pallet structures have experienced only limited usage in the industry. Additionally, because the vertically orientated wire reels, each weighing upwards of 1,000 pounds per reel, rest on recessed support members associated with the pallet, it is oftentimes difficult to remove the vertically orientated wire reels on the recessed supports on the pallet structure for subsequent usage.

SUMMARY OF THE INVENTION

It is an object of the present invention to provide an improved stackable dispensing apparatus for wire reels.

Another object of the present invention is to provide a novel dispensing apparatus or skid for wire reels wherein the vertically orientated wire reels may be simply and readily rolled off of the dispensing apparatus or skid for subsequent usage.

A further object of the present invention is to provide a stackable dispensing apparatus or skid for wire reels wherein each dispensing apparatus may be readily stacked one on top of the other.

It is still another object of the present invention to provide a novel dispensing apparatus or skid for receiving vertically orientated reels of wire wherein the reels of wire are firmly locked within the frame of the apparatus or skid until the reels of wire are removed from the apparatus or skid without the use of auxiliary reel retaining means, such as bands or straps.

It is yet another object of the present invention to provide a novel dispensing apparatus or skid member for receiving a plurality of vertically orientated reels of wire wherein the frame of the apparatus or skid includes a pivotal retaining means which retains the reels of wire within the dispensing apparatus or skid member.

It is another object of the present invention to provide a novel dispensing apparatus or skid for receiving a plurality of vertically orientated reels of wire wherein the frame of the apparatus includes individual retaining means engageable with each individual reel of wire to retain a respective reel of wire within the dispensing apparatus.

It is still a further object of the present invention to provide a stackable dispensing apparatus or skid for wire reels that is simple and economical to fabricate and which is virtually maintenance free over a long useful life.

Finally, it is an object of the present invention to provide a rigid steel stackable dispensing apparatus or skid member wherein one skid member may readily nest one upon another skid member to provide a stackable dispensing apparatus wherein the rail support members maintain the vertically orientated reels of wire as low as possible on the skid to maximize the stability of the stacked dispensing apparatus.

In accordance with the present invention, the stackable dispensing apparatus or skid shipment member, for storing and dispensing reels of wire, includes a pallet skid member, preferably substantially rectangular in shape and having a front portion and a rear portion extending the length of the skid member. A plurality of rail members are provided on the skid member and perpendicularly extend from the lower front edge portion to the lower rear edge portion of the skid member. Each pair of the rail members is adapted to and structurally arranged in horizontal position to receive the edges of a reel of wire when the reels of wire are vertically orientated in a side-by-side relationship on the pallet skid member. The skid member further includes corner post members extending upwardly from each corner of the skid member and frame support members secured between each of the corner post members and extending across the ends of the pallet skid members and across the rear portion of pallet skid member to reinforce the corner post members. V-grooved or L-shaped channel members are secured to the tops of the corner post members and either extend across the length of the front and rear portions of the skid member or extend across the sides of the skid member or extend around all sides of the skid member. Additionally, complimentary V-grooved or tubular members are secured to the bottom of the corner post member and either extend across the length of the front and rear portions or extend across the sides of the skid member or extend around the lower bottom of the skid member. The upper and lower V-grooved members are adapted to be matingly engageable with one another to permit nesting and stacking of one skid member upon another skid member and to provide a linear contact between the stacked and nested skid members.

The dispensing apparatus includes retaining means hingedly mounted to the frame support members extending across the ends of the skid member between the corner post members, with the retaining means adapted to pivotally move from a closed position wherein the vertically orientated reels of wire are retained within the dispensing skid pallet apparatus to an open position wherein the vertically orientated reels of wire may be selectively removed from the dispensing apparatus for use at a work station. The retaining means may be mounted to retain single reels of wire or the retaining means may extend the length of the skid to retain a plurality of reels on the skid, as desired.

The present invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For purposes of facilitating an understanding of the invention, there is illustrated in the accompanying drawings a preferred embodiment thereof, from an inspection of which, when considered in connection with the following description, the invention, its construction and operation, and many of its advantages will be readily understood and appreciated.

FIG. 6 is a partial view taken along the line 6—6 of FIG. 2 illustrating the v-grooved members secured to and extending across the length of the front and rear portions of the upper post members of the pallet skid member to provide a registry between upper and lower skid members in accordance with the present invention;

FIG. 7 is a partial view similar to FIG. 6 illustrating the positioning of the v-grooved members each secured to and extending across the upper end or side surfaces of the upper post members of the pallet skid member to provide registry between upper and lower skid members in accordance with a further embodiment of the present invention;

FIG. 8 is a partial view similar to FIG. 6 illustrating the positioning and securing of the v-groove members each secured to and extending between the four upper end surfaces of the upper post members of the pallet skid member in accordance with still a further embodiment of the present invention to provide registry between upper and lower skid members when the dispensing apparatus is stacked one upon the other;

FIG. 9 is a end view of a stackable dispensing apparatus in accordance with one embodiment of the present invention illustrating the pivotal movable hinge retaining means individually mounted with respect to each of the reels of wire and operable between a closed retaining position and an open position;

FIG. 10 is a view taken along line 10—10 of FIG. 9 illustrating a locking mechanism which is engageable with a projection on a reinforcing member of one pallet skid member to permit locking the stacked dispensing skid members together when in the stacked condition;

FIG. 11 is a sectional view taken along line 11—11 of FIG. 9 illustrating individually mounted hinge retaining means which are selectively operable between a closed retaining position and an open position retain individual reels of wire in the dispensing apparatus in accordance with the present invention; and FIG. 12 is an enlarged perspective view taken along lines 12—12 of FIG. 11 illustrating the locking together of adjacent hinge retaining means to permit the selective removal of a single reel of wire from the dispensing apparatus in accordance with the present invention.

DETAILED DESCRIPTION

Figure 1:
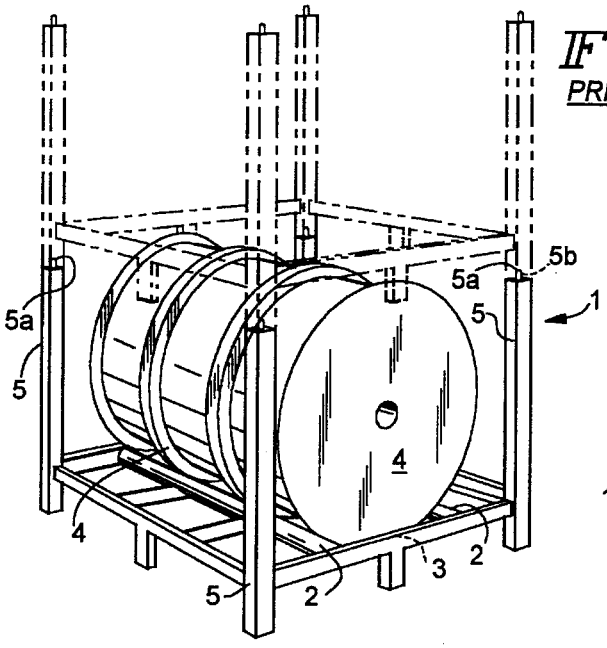
FIG. 1 PRIOR ART
FIG. 1 is a perspective view of a stackable dispensing apparatus for wire reels in accordance with the prior art.

In accordance with known prior art structures, as illustrated in FIG. 1, such known pallet structures 1 are generally rectangular is configuration and include a pair of lengthwise lower support members 2 which provide a recess 3 to accommodate a plurality of reels of wire 4 vertically positioned thereon. The lower support members 2 are spaced several inches above the floor surface. Additionally, the prior art pallet structures 1 include a plurality corner posts 5 extending upwardly. Each of the upper ends of the posts include a protuberance or a projection 5*a* and each of the lower ends of the posts include a recess opening 5*b*. The wire reels are positioned by a fork lift onto the support members 2 and the pallet structures are stacked one upon the other by aligning the upper projections 5*a* on the posts with the recess 5*b* on the lower end of posts 5. This is a difficult process because of the excessive weight of wire on each pallet structure and problems of miss alignment of the respection projections and recesses on the corner posts. Additionally, the removal of reels of wire requires a substantial force to overcome the inertia of the reel resting in the recess 3 provided by the lower support members 2 extending between the ends of the pallet structure.

Figure 2:
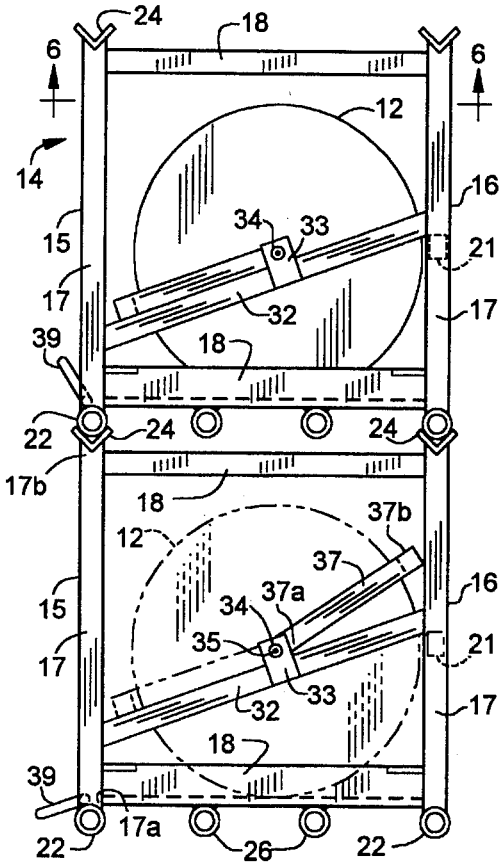
FIG. 2 is an end view of the stackable dispensing apparatus in accordance with the present invention illustrating the pivotal movable hinged retaining means operable between the closed retaining position in the upper skid member and the open position in the lower skid member.
Figure 3:
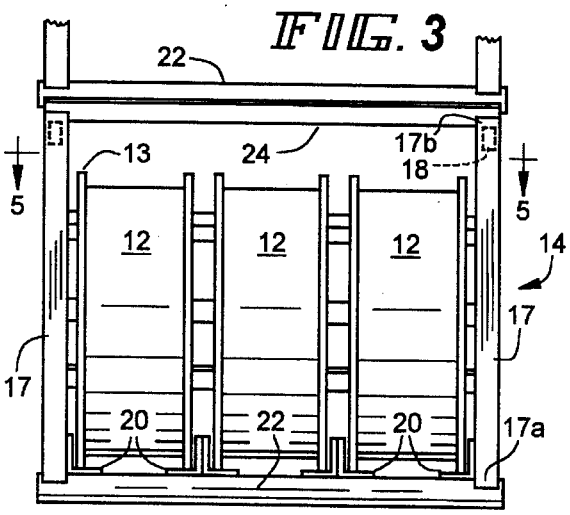
FIG. 3 is a frontal view of the stackable dispensing apparatus in accordance with the present invention illustrating the hinged retaining means in the open position which permits the selective removal of the reels of wire from the dispensing apparatus.
Figure 4:
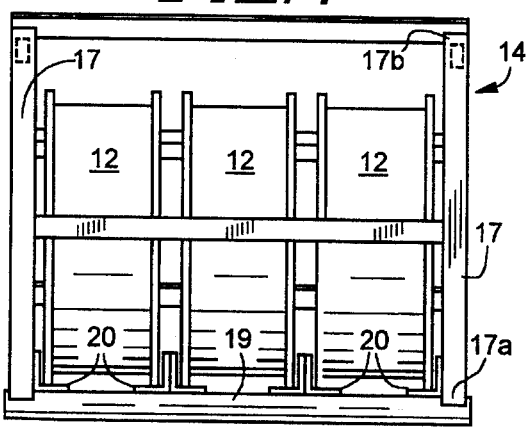
FIG. 4 a rear view of the stackable dispensing apparatus in accordance with the present invention.
Figure 5:
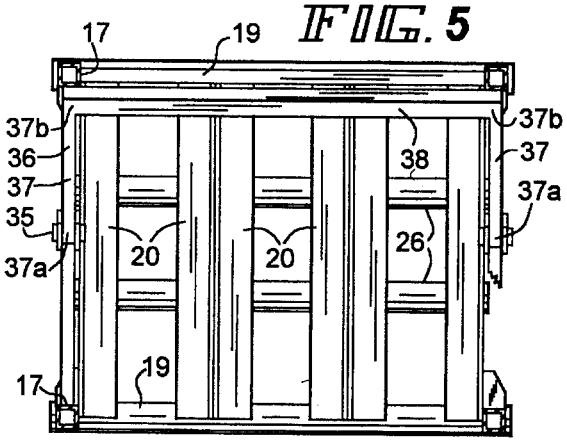
FIG. 5 is a view taken along line 5—5 of FIG. 3 with the wire reels removed from the dispensing apparatus illustrating the rail members extending perpendicularly from the lower front of the apparatus to the back of the apparatus for supporting the edges of the reels of wire in accordance with the present invention.

Referring now to the drawings wherein like numerals have been used throughout the several views to illustrate the same or similar parts, a stackable dispensing apparatus 10 for storing and dispensing reels of wire 12 in accordance with one embodiment of the present invention is illustrated in FIGS. 2–5. The stackable dispensing apparatus 10 is comprised of a pallet skid member 14 which is substantially rectangular in configuration and having a front portion 15 and a rear portion 16 extending the length of the skid member. The pallet skid member 14 includes a plurality of corner post members 17 extending upwardly in substantially a parallel alignment from the corners of the pallet skid member 14 and end frame support members 18 secured to and extending between each of the corner post members 17 adjacent the ends 17*a* and 17*b* of the posts 17, as shown in FIGS. 2 and 4. Also, positioned intermediate between the ends 17*a* and 17*b* of the corner posts 17 on the rear portion 16 of the skid member 14 is a rear support or reel retaining member 21 which prevents the reels of wire 12 from being removed from the back of the skid member, as will hereinafter be described. As illustrated in FIG. 5, a plurality of rail members 20, extending perpendicularly from the front portion 15 to the rear edge portion 16 of the pallet skid member 14 are provided, with each pair of the rail members adapted to receive and engage the edges 13 of the reels of wire 12 when the reels are vertically oriented in a side-by-side relationship on the pallet skid member 14.

As shown in FIG. 2, the lower end portion 17*a* of each of the corner post members 17 includes a lower support member 22 mounted thereto which is adapted to engage and be received by an L-shaped, V-grooved or trocar configured upper support member 24 which is secured to the top end portion 17*b* of each of the corner members along the front portion 15 and rear portion 16. This structure permits the upper L-shaped or V-grooved member 24 to receive the lower support member on an aligned adjacent pallet skid member to permit registry and stacking of one skid member onto another skid member, as illustrated in FIG. 2. Moreover, it is within the scope of the present invention that the lower support member 22 may be tubular in form, as shown in FIG. 2, or may be in the form of a complementary projecting L-shaped member, as shown in FIG. 9, which structures permit the registry, the stacking or the nesting of one skid member onto another skid member and provide for a linear or elongated support between stacked skid members. It is merely important to the present invention that the structure permits the registry, the nesting and the stacking and linear support of one pallet skid member with respect to another pallet skid member to provide the stackable dispensing apparatus in accordance with the present invention.

For example, it is clearly within the scope of the present invention that the structure for providing the registry between an upper skid member and a lower skid member may be provided by mounting the v-grooved upper support member 24 onto the upper end portion 176 of corner post member 17 that extends along the sides of pallet skid member 14, as illustrated in FIGS. 2 and 6. In a similar fashion, complimentary lower support members may be mounted onto the lower end portions of the corner post members 17*a* along the ends of the skid members, to permit the registry and stacking of the pallet skid members one on top of the each other. Accordingly, as illustrated in FIG. 7, the engagement and registry between the nested skid members may occur along the ends of the skid members.

In a further embodiment of the present invention, FIG. 8 illustrates a rectangular, substantially square stackable dispensing apparatus wherein the upper end portions 17*b* of the corner post members and the lower end portions 17*a* of the corner post member include v-grooved support members 24 extending between the corner post members. In such a apparatus, when one skid member is stacked or nested upon another skid member, stacking and registry occurs on all sides of the dispensing apparatus 10.

Thus, in the embodiments illustrated in FIGS. 6, 7 and 8, the stacking and registry of one skid member upon another skid member may occur along the front and back of the skid members, along the sides of the skid members or on both the sides and the front and back of the skid members, respectively. However, it is within the scope of the present invention that stacking and readjusting must occur on at least two sides of the skid member that extend between the four corner post members.

As shown in FIGS. 2 and 9, preferably, the pallet skid members include reinforcing members 26 which extend the length of the skid member between the end or side frame support members 18. These reinforcing members are illustrated as tubular members, either circular (FIG. 2) or rectangular (FIG. 9) in cross-section. Again, it is within the scope and spirit of the present invention that the reinforcing members may be of any cross-sectional configuration wherein the reinforcing members are of sufficient strength to reinforce the pallet skid member to retain and hold the several thousand of pounds of wire each is designed to hold and stack.

The pallet skid member 14 of the present invention includes a retaining means 30 adapted to pivotally move between a closed position wherein the vertically orientated reels of wire 12 are retained within the skid member 14 to an open position wherein the vertically orientated reels of wire may be selectively removed from the dispensing apparatus for use at a work station. The retaining means 30, as illustrated in FIGS. 2 and 4, includes end retaining means supports 32 extending between the corner posts 17. The end retaining means supports 32 include a bracket member 33 mounted thereto which provides a pivot point 34 for the retaining means 32. The pivot point 34, is preferably positioned at the central axis of the reels of wire 12. The retaining means 30 is a substantially U-shaped member 36 (FIG. 5) comprised of arms 37 and a connector support member 38 extending between the ends 37*b* of the arms 37. The ends 37*a* of the arms 37 are pivotally mounted or hinged to the pivot point 34 by pin 35. When the retaining means 30 is in the closed position, the reels of wire 12 are fully retained within the pallet skid member 14, as illustrated in the upper skid member 14 stacked upon the lower skid member in FIG. 2 and in FIG. 4. When the retaining means 30 has been pivotally rotated from the closed position to the open position, as illustrated in the lower skid member 14 in FIG. 2 and in FIG. 5, (with the reels not shown), the reels of wire 12 may be readily and selectively removed from the dispensing apparatus by rolling the vertically orientated reels of wire from the skid member. The horizontal and planar surface of the rail members aids and facilitates the easy removal of the reels from the skid member.

The skid member may include a ramp member 39 hingedly mounted to and extending from the lower front portion 15 of the skid member 14, as shown in FIG. 2. The ramp member is selectively movable from a substantially vertical position, as shown in the upper skid member 14 in FIG. 2, to a substantially horizontal position, as shown in the lower skid member 14 in FIG. 2, to aid and to facilitate the easy removal of the reels of wire 12 from the dispensing apparatus 10.

When the retaining means 30 is in the closed position, as shown in FIG. 4, and in the upper skid member 14 in FIG. 2, the reels of wire 12 are confined and retained on the rail members 20 of the skid members 14 between the connector support member 38 of the retaining means 30 and the reel retaining member 21. When it is desired to remove one or more reels of wire 20 from the skid member 14, the retaining means 30 is pivotally rotated from the closed retaining position to the open position, as shown in the lower skid member 14 in FIGS. 2, 3 and 5. As is apparent from this disclosed embodiment of the retaining means 30, the arms 37 are of sufficient length such that the connector support member 38 of the U-shaped member has sufficient clearance to pivotally rotate about the edges 13 of the reels of wire 12, as shown in the lower skid member 14 in FIG. 2.

In FIGS. 9 and 11, a further embodiment of the retaining means 30 in accordance with the present invention is illustrated. In this embodiment, the retaining means 30 is disclosed to provide selective retention of individual vertically orientated reels of wire 12*a*, 12*b* and 12*c* within the skid member 12. Specifically, the retaining means includes a plurality of arms 37 that have the outside arms 37*d* pivotally mounted to the end retaining means supports 32 and bracket member 33, with the arms connected together by connector or support members 38, as has previously been described with respect to FIGS. 2 and 4. The interior arms 37*c* are pivotally mounted to auxiliary support members 40, preferably extending inwardly from the reel retaining member 21. The auxiliary support member 40 and associated bracket members provide a pivot point 34 for the interior arms 37*c* substantially at the central axis of the reels of wire, as has previously been described. In this disclosed embodiment, when the retaining means 30 is in the closed position, the individual retaining means 30*a*, 30*b* and 30*c*, respectively, fully retain reels of wire 12*a*, 12*b* and 12*c* within the pallet skid member 14, as shown in FIG. 11. Additionally, a plate means or member 42 is provided between adjacent retaining means 30*a*, 30*b* and 30*c* to selectively permit the pivotal movement of one or more of the retaining means 30*a*, 30*b* and 30*c* from the closed position to the open position to permit removal of one or more reels of wire 12*a*, 12*b* and 12*c* from the pallet skid member, as shown in FIGS. 9 and 11. The plate means or member 42 is removably fastened by fastener elements 41 to adjacent connector support members 38 extending between the outside arms 37*d* and the interior arms 37*c*, as shown in FIGS. 11 and 12.

If it is desired to only remove a single reel of wire 12*a* from the skid pallet member 14, plate member 42 is unfastened from the connector support member 32 on retaining means 30*a* and retaining means 30a is pivotally rotated from the closed position to the open position, as shown in FIG. 9. Then reel of wire 12*a* may be selectively removed from the pallet skid member while reels of wire 12*b* and 12*c* are firmly retained and locked on the pallet.

The present invention includes locking means 50 which permits the stacked and nested pallet skid members to be locked together to prevent the shifting and movement of one pallet skid member with respect to another skid member. As shown in FIG. 10, the locking means 50 includes an extension member 43 extending outwardly from one of the reinforcing members 26. The extension member includes a recessed portion 44 which is structurally arranged to receive a locking pin member 45 that is slidably mounted within openings 47 in brackets 46 extending upwardly from the end frame support members 18. When one pallet skid member 14 is stacked and nested upon another pallet skid member, the locking pin 45 is inserted through openings 47 in brackets 46 to firmly lock one skid member to another, as shown in FIG. 10. A chain 48 is attached to the locking pin to prevent loss of the locking pin when the locking means is disconnected.

The advantages of the present invention is readily apparent to those skilled in the art. For instance, prior art pallet structures have heretofore included structure which have prevented the easy and ready removal of reels of wire from the pallet structure. The present invention and the associated rail members and retaining means permits the easy and ready removal of reels of wire from the pallet skid member. In addition, the prior art pallet structures have heretofore included structure which have prevented easy alignment and stacking of the pallet structures one on tope of the another. The present invention and associated V-grooved or recessed support members provide a linear support between skid members and permit nesting and stacking of the pallet skid members one on top of another readily, a structure that readily overcomes the deficiencies of the prior art pallet structures.

From the above description of the present invention, those skilled in the art may perceive other improvements, changes and modifications. Such improvements, changes and modification are intended to be covered by the following appended claims:

I claim:

1. Stackable pallet skid members for storing and dispensing reels of wire, with each of the pallet skid members being substantially rectangular in shape and having a front portion, a rear portion and two side portions, including in combination:

four corner post members extending vertically upwardly in substantially parallel alignment, with each of said corner post members having upper and lower ends each terminating in a single plane;

end support members secured and connected to respective pairs of said corner posts members adjacent to said upper and lower ends to define the side portions of the pallet skid members;

at least one rear support member secured add connected to the pair of said corner post members intermediate the end thereof to define the rear portion of the pallet skid members;

end retaining means supports extending between respective pairs of said corner post members intermediate the upper and lower ends thereof, said end retaining means supports having bracket members mounted thereto;

a plurality of rail members horizontally extending from the lower front edge portion to the rear edge portion of the skid member, with each pair of said rail members structurally arranged to receive and support the reel sides of a reel of wire when the reel of wire is vertically oriented in a side-by-side relationship on the pallet skid member;

upper support members secured and connected to the upper ends of each pair of said corner post members and extending the length of the front and rear portions of the skid members;

lower support members secured and connected to the lower ends of each pair of said corner post members and extending the length of the front and rear portions of the skid members, with said upper support members and said lower support members structurally arranged to provide a linear extending nesting and stacking of the pallet skid members when one pallet skid member is positioned on top of another pallet skid member; and retaining means hingedly mounted to said bracket members on said end retaining means supports of the pallet skid member, with said retaining means adapted to pivotally move from a closed position wherein the vertically oriented reels of wire are retained on the pallet skid member to an open position wherein the vertically oriented reels of wire may be removed from the pallet skid member by rolling the reels along said rail members.

2. In the stackable pallet skid members in accordance with claim 1, wherein either of said upper support members and said lower support members are recessed in cross-section and the other of said upper support members and said lower support members include a complimentary projection in cross-section, with said upper support members and said lower support members structurally arranged to provide nesting and stacking of the pallet skid members when one pallet skid member is positioned on top of another pallet skid member.

3. In the stackable pallet skid members in accordance with claim 1, wherein said upper support members are a recessed L-shaped configuration and said lower support members are a complimentary projecting L-shaped configuration, with said upper support members and said lower support members structurally arranged to provide nesting and stacking of the pallet skid members when one pallet skid member is positioned on top of another pallet skid member.

4. In the stackable pallet skid members in accordance with claim 1, wherein said upper support members are trocar configured members and said lower support members are a complimentary projecting tubular configuration, with said upper support members and said lower support members structurally arranged to provide nesting and stacking of the pallet skid members when one pallet skid member is positioned on top of another pallet skid member.

5. In the stackable pallet-skid members in accordance with claim 1, wherein the front edge portion of the pallet skid member includes a ramp member mounted thereto, with said ramp member structurally arranged to cooperate with said plurality of said rail members to facilitate removal of a reel of wire from the pallet skid member.

6. In the stackable pallet skid member in accordance with claim 5, wherein said ramp member is hingedly mounted to the front edge portion of the pallet skid member and movable between a substantially vertical upright position to a downwardly substantially horizontal position wherein said ramp member cooperates with the plurality of rail members to facilitate removal of a reel of wire from the pallet skid member.

7. In the stackable pallet skid member in accordance with claim 1, further including reinforcing members mounted to said end support members secured adjacent to said lower ends of said pair of corner posts, with said reinforcing members extending the length of the front and rear portions of the pallet skid member.

8. In the stackable pallet skid member in accordance with claim 1, wherein said pallet skid members further include reinforcing members mounted to said end support members secured adjacent to said lower ends of said pair of corner posts, with said reinforcing members extending the length of the front and rear portions of the pallet skid member.

9. In the stackable pallet skid members in accordance with claim 8, further including a locking means structurally arranged on said skid members to lock said skid members together when one pallet skid member is nested and stacked on top of another pallet skid member.

10. In the stackable pallet skid members in accordance with claim 9, wherein said locking means includes an arm member having a recess therein, said arm member extending axially outwardly from at least one of said reinforcing members, and a bracket having openings therein, and a removable pin assembly mounted to said end support member secured to the corner post members adjacent the upper ends thereof, with said recess in said arm member aligned to engage within said brackets to permit said pin assembly to be inserted therein to lock said pallet skid members together when one pallet skid member is nested and stacked on top of another pallet skid member.

11. In the stackable pallet skid members in accordance with claim 1, wherein said retaining means is a U-shaped member, with each of the extensions thereof hingedly mounted to the side portions of the pallet skid member, said retaining means being operable and pivoted about an arc between said open position wherein said retaining means engages the rear portion of the pallet skid member and said closed position wherein said retaining means is positioned below the pivot point thereof to retain the vertically orientated reels on the pallet member.

12. In the stackable pallet skid members in accordance with claim 1, wherein said retaining means is comprised of a U-shaped member having arm extensions and a connection support member therebetween, with each of said arm extensions thereof hingedly mounted to said bracket members of said end retaining means supports to provide a pivot point for said retaining means substantially on the central axis of the vertically orientated reels of wire.

13. In the stackable pallet skid member in accordance with claim 1, wherein said retaining means is comprised of a plurality of U-shaped members each hingedly mounted to the pallet skid member for pivotal movement between a closed position wherein a vertically orientated reel of wire is retained on the pallet skid member to an open position wherein a vertically orientated reel of wire is removable from the skid member.

14. Stackable pallet skid members for storing and dispensing reels of wire, with each of the pallet skid members being substantially rectangular in shape and having a front portion, a rear portion and two side portions, including in combination:

four corner post members extending vertically upwardly in substantially parallel alignment, with each of said corner post members having upper and lower ends each terminating in a single plane;

end support members secured and connected to respective pairs of said corner posts members adjacent to said upper and lower ends to define the side portions of the pallet skid members;

at least one rear support member secured and connected to the pair of said corner post members intermediate the ends thereof to define the rear portion of the pallet skid members;

end retaining means supports extending between respective pairs of said corner post members intermediate the upper and lower ends thereof, said end retaining means supports having bracket members mounted thereto;

a plurality of rail members horizontally extending from the lower front edge portion to the rear edge portion of the skid member, with each pair of said rail members structurally arranged to receive and support the reel sides of a reel of wire when the reel of wire is vertically oriented in a side-by-side relationship on the pallet skid member;

upper support members secured and connected to the upper ends of each pair of said corner post members and extending the length of the side portions of the skid members;

lower support members secured and connected to the lower ends of each pair of said corner post members and extending the length of the side portions of the skid members, with said upper support members and said lower support members structurally arranged to provide a linear extending nesting and stacking of the pallet skid members when one pallet skid member is positioned on top of another pallet skid member; and retaining means hingedly mounted to said bracket members on said end retaining means supports of the pallet skid member, with said retaining means adapted to pivotally move from a closed position wherein the vertically oriented reels of wire are retained on the pallet skid member to an open position wherein the vertically oriented reels of wire may be removed from the pallet skid member by rolling the reels along said rail members.

15. In the stackable pallet skid members in accordance with claim 14, wherein either of said upper support members and said lower support members are recessed in cross-section and the other of said upper support members and said lower support members include a complimentary projection in cross-section, with said upper support members and said lower support members structurally arranged to provide nesting and stacking of the pallet skid members when one pallet skid member is positioned on top of another pallet skid member.

16. In the stackable pallet skid members in accordance with claim 14, wherein said upper support members are a recessed L-shaped configuration and said lower support members are a complimentary projecting L-shaped configuration, with said upper support members and said lower support members structurally arranged to provide nesting and stacking of the pallet skid members when one pallet skid member is positioned on top of another pallet skid member.

17. In the stackable pallet skid members in accordance with claim 14, wherein said upper support members are trocar configured members and said lower support members are a complimentary projecting tubular configuration, with said upper support members and said lower support members structurally arranged to provide nesting and stacking of the pallet skid members when one pallet skid member is positioned on top of another pallet skid member.

18. In the stackable pallet skid members in accordance with claim 14, wherein the front edge portion of the pallet skid member includes a ramp member mounted thereto, with said ramp member structurally arranged to cooperate with said plurality of said rail members to facilitate removal of a reel of wire from the pallet skid member.

19. In the stackable pallet skid member in accordance with claim 18, wherein said ramp member is hingedly mounted to the front edge portion of the pallet skid member and movable between a substantially vertical upright position to a downwardly substantially horizontal position wherein said ramp member cooperates with the plurality of rail members to facilitate removal of a reel of wire from the pallet skid member.

20. In the stackable pallet skid member in accordance with claim 14, further including reinforcing members mounted to said end support members secured adjacent to said lower ends of said pair of corner posts with said reinforcing members extending the length of the front and rear portions of the pallet skid member.

21. In the stackable pallet skid member in accordance with claim 14, wherein said pallet skid members further include reinforcing members mounted to said end support members secured adjacent to said lower ends of said pair of corner posts, with said reinforcing members extending the length of the front and rear portions of the pallet skid member.

22. In the stackable pallet skid member in accordance with claim 21, further including a locking means structurally arranged on said skid members to lock said skid members together when one pallet skid member is nested and stacked on top of another pallet skid member.

23. In the stackable pallet skid members in accordance with claim 22, wherein said locking means includes an arm member having a recess therein, said arm member extending axially outwardly from at least one of said reinforcing members, and a bracket having openings therein, and a removable pin assembly mounted to said end support member secured to the corner post members adjacent the upper ends thereof, with said recess in said arm member aligned to engage within said brackets to permit said pin assembly to be inserted therein to lock said pallet skid members together when one pallet skid member is nested and stacked on top of another pallet skid member.

24. In the stackable pallet skid members in accordance with claim 14, wherein said retaining means is a U-shaped member, with each of the extensions thereof hingedly mounted to the side portion of the pallet skid member, said retaining means being operable and pivoted about an arc between said open position wherein said retaining means engages the rear portion of the pallet skid member and said closed position wherein said retaining means is positioned below the pivot point thereof to retain the vertically orientated reels on the pallet member.

25. In the stackable pallet skid members in accordance with claim 14, wherein said retaining means is comprised of a U-shaped member having arm extensions and a connector support member therebetween, with each of the arm extensions thereof hingedly mounted to said bracket members on said end retaining means supports to provide a pivot point for said retaining means substantially on the central axis of the vertically orientated reels of wire.

26. In the stackable pallet skid member in accordance with claim 14, wherein said retaining means is comprised of a plurality of U-shaped members each hingedly mounted to the pallet skid member for pivotal movement between a closed potion wherein a vertically orientated reel of wire is retained on the pallet skid member to an open position wherein a vertically orientated reel of wire is removable from the skid member.

* * * * *

UNITED STATES PATENT AND TRADEMARK OFFICE

CERTIFICATE OF CORRECTION

PATENT NO. : 5,588,372
DATED : December 31,1996
INVENTOR(S) : Patrick J. Kelly

It is certified that error appears in the above-indentified patent and that said Letters Patent is hereby corrected as shown below:

| COLUMN | LINE | |
|---|---|---|
| 7 | 64 | Delete "add" insert -- and --; |

Signed and Sealed this

Fourth Day of March, 1997

Bruce Lehman

*Attest:*

BRUCE LEHMAN

*Attesting Officer*

*Commissioner of Patents and Trademarks*